US007219797B2

(12) United States Patent
Kroeze et al.

(10) Patent No.: US 7,219,797 B2
(45) Date of Patent: May 22, 2007

(54) BOX WITH INSERT THAT EXTENDS FROM A SIDE AND THAT DIVIDES THE BOX INTO COMPARTMENTS AND METHODS FOR FORMING AND USING

(75) Inventors: Matt Kroeze, Kent, WA (US); George Jamison, Gig Harbor, WA (US)

(73) Assignee: Alliance Packaging LLC., Renton, WA (US)

( * ) Notice: Subject to any disclaimer, the term of this patent is extended or adjusted under 35 U.S.C. 154(b) by 368 days.

(21) Appl. No.: 10/345,058

(22) Filed: Jan. 14, 2003

(65) Prior Publication Data

US 2003/0168369 A1 Sep. 11, 2003

Related U.S. Application Data

(60) Provisional application No. 60/348,969, filed on Jan. 14, 2002.

(51) Int. Cl.
*B65D 85/52* (2006.01)

(52) U.S. Cl. ..... 206/423; 206/756; 206/784; 47/84; 229/120.18

(58) Field of Classification Search ..... 229/120.18, 229/122.32, 127.34, 122.34; 206/423, 277, 206/756, 757, 591, 592, 784; 47/62, 84
See application file for complete search history.

(56) References Cited

U.S. PATENT DOCUMENTS 760,866 A * 5/1904 Lord ..... 211/63
880,549 A * 3/1908 Lord ..... 47/84
1,337,091 A * 4/1920 Neski ..... 206/443
1,493,152 A * 5/1924 Gardner ..... 47/84
1,606,523 A * 11/1926 Gardner ..... 47/84
1,669,617 A * 5/1928 Kennedy ..... 47/84
2,682,949 A * 7/1954 Whitehead ..... 206/446
3,095,086 A * 6/1963 Berg ..... 206/784
3,752,035 A * 8/1973 Cozzy et al. ..... 89/13.05
3,973,356 A * 8/1976 Schacht ..... 47/41.01
4,957,237 A * 9/1990 Madonna et al. ..... 229/120
5,803,267 A * 9/1998 Tu et al. ..... 206/576
6,789,678 B2 * 9/2004 Auclair ..... 206/590

* cited by examiner

*Primary Examiner*—Mickey Yu
*Assistant Examiner*—Jerrold Johnson
(74) *Attorney, Agent, or Firm*—Seed Intellectual Property Law Group PLLC

(57) ABSTRACT

A box, a blank that can be easily formed into the box via an intermediate box assembly, and methods for generating and using the box allows one to quickly and easily package flowers and accessories for shipment to a consumer without bending, bruising or otherwise damaging the flowers. The box includes an insert that extends from a side of the box and is pivotable into an interior of the box. The insert includes a divider that extends from the insert and can be attached to a side after the flowers have been placed in the interior to extend between two sides and divide the interior into two compartments. One compartment contains the flower portion of the flowers while the other compartment contains the stem portion of the flowers and the accessories. The blanks allow one to quickly and easily generate the boxes and ensure that the box generated will have an insert to protect the flowers during shipment. The intermediate box assembly can be generated by the manufacturer of the blank and easily shipped to or stored by a florist. Then, to ship flowers to a customer, the florist can quickly and easily generate the box from the intermediate box assembly and place the flowers into the box without bending, bruising or otherwise damaging the flowers.

17 Claims, 14 Drawing Sheets

BOX WITH INSERT THAT EXTENDS FROM A SIDE AND THAT DIVIDES THE BOX INTO COMPARTMENTS AND METHODS FOR FORMING AND USING

PRIORITY CLAIM

This application claims priority from U.S. Provisional application No. 60/348,969, filed 14 Jan. 2002, which is presently pending.

BACKGROUND

Fresh flowers smell wonderful and are very special to the person who receives them as a gift. Combining accessories such as candies, a ring or any other type of jewelry, a stuffed animal, a vase, plant food or any other desired items, with the fresh flowers often emphasizes the emotion conveyed to the person receiving them. Consequently, many people want to include accessories with the flowers they send to a loved one.

To satisfy this desire, florists place a box containing the accessories into the box containing flowers. Because fresh flowers are typically fragile and would break or bruise after contact with the accessories box, many florists divide the interior of the flower box into compartments with a divider. One compartment contains the fragile flower portions of the flowers, while the other compartment contains the stem portions of the flowers and accessories box. Thus, the flower portions of the flowers are protected during shipment of the flowers and accessories.

FIGS. 1 and 2 illustrate a conventional flower box 20 used to ship flowers to consumers. FIGS. 1 and 2 also illustrate a conventional insert 22 that includes a divider 24. To package flowers and accessories for shipment to a consumer, the florist typically does the following. First, the florist generates the box 20 from a blank by folding the various panels 21 and then gluing some of the panels together. This typically involves folding each panel individually and applying an adhesive or inserting a flap. Then, the florist generates the insert 22 from a blank by folding the divider 24 away from the stem section 26 and then folding the flower section 28 parallel or substantially parallel to the stem section 26. Next, he/she folds the sides 30 of the insert 22 to a position shown in FIG. 2 so that the insert 22 can be inserted into the box 20. After inserting the insert 22 into the box 20, he/she inserts the flowers into the box 20 by threading them through the divider so that the flower portions of the flowers are under the flower section 28 and the stems of the flowers are above the stem section 26. Then, he/she places the accessories box (not shown) above the stems.

Unfortunately, this packaging process has three problems. First the process is time consuming and can easily damage the flowers. Because each panel is typically folded individually, the process of generating the box 20 and insert 22, and inserting the insert 22 into the box 20 can be time consuming. The flowers can be easily damaged when the florist threads the flowers through the divider because the stem portions and flowers portions can easily bruise when contacting the divider 24 or the panels 21 of the box 20. Consequently, a florist usually bends the stem portion of the flowers to avoid bruising the stem and flower portions. But bending the stem portions can also damage the flowers. And once damaged, the flowers are typically replaced and thrown away. Second, a florist must keep track of two inventories—the blanks for the inserts 22 and the blanks for the boxes 20, which requires additional work. And third, the blanks for the box 20 or insert 22 could be misplaced or used up before the blanks of the other component are used up, leaving the blanks of the other component temporarily unusable.

Thus there is a need for a box or container that can be quickly and easily generated from a blank that includes an insert with a divider to divide the interior of the box into two or more compartments and protect one or more flowers contained in the box during transportation. Furthermore, there is a need for an insert with a divider that allows one to place the one or more flowers in the box without bending, bruising or damaging them.

SUMMARY OF THE INVENTION

The invention provides boxes, blanks, intermediate box assemblies and methods for generating the boxes and intermediate box assemblies from the blanks and using the boxes. The boxes allow one to quickly and easily package flowers and accessories for shipment to a consumer without bending, bruising or otherwise damaging the flowers. The boxes include a plurality of sides and a bottom that are connected to each other to define an interior. The boxes also include an insert that extends from at least one of the sides or bottom. The insert includes a divider that can extend between one of the sides of the box to another side to divide the interior into two or more compartments when the insert is inserted into the interior of the box. To allow one to place the flowers in the box without bending, bruising or otherwise damaging the flowers, the divider initially extends along one of the sides of the box when the insert is inserted into the interior. Then, after the flowers are placed in the box, the divider can be pivoted to extend between two of the sides of the box and can be attached to the side it is pivoted toward to divide the interior into the compartments. Typically, one compartment contains the fragile flower portion of the flowers, while another compartment contains the less fragile stem portion of the flowers and the accessories. Thus, one can quickly and easily package the flowers in the box without bending, bruising or otherwise damaging the flowers, and the fragile flower portions of the flowers can be protected from the accessories or other items placed in the box that could damage the flower portions during shipment.

The blanks allow one to quickly and easily generate the boxes and ensure that all of the components of the boxes will be available to protect the flowers during shipment. The blanks include at least two side sections and a bottom section connected to each other that define an interior when the sections are pivoted relative to each other to form the box. The blanks also include an insert section that extends from one of the side sections and can include at least two insert portions that can be pivoted relative to each other to generate the insert. The insert section includes a divider that extends from one of the insert portions and that, when desired, can divide the interior into two compartments when the interior is generated. With the insert section extending from one of the side or bottom sections of the blank, the insert section is retained to the blank. Thus, the blanks ensure that an insert will be available to protect the flowers during shipment in the generated box. This also eliminates the need to keep track of two sets of inventory and greatly reduces the possibility of not being able to generate a box with an insert because either the insert or box is missing.

The intermediate box assemblies eliminate most of the time consuming work performed by one in generating the box before packaging the flowers and accessories because the manufacturer of the blanks can easily generate the intermediate box assemblies from the blanks with conventional automated box forming equipment. Furthermore, because the intermediate box assemblies are flat or substantially flat, the intermediate box assemblies can be easily shipped to and stored by one packaging the flowers for shipment (typically a florist). In this and certain other embodiments, to generate the intermediate box assembly, one pivots a flap of a first side section of the blank. Then one pivots a flap of a bottom side section of the blank and attaches a first portion of the flap to the flap of the first side section. Then one pivots a second portion of the flap of the bottom section, pivots a flap of the second side section of the blank, and attaches the flap of the second side section to the second portion of the flap of the bottom section by pivoting the second side section toward the bottom section. Then, to generate the box from the intermediate box assemblies, one pivots the second side section away from the bottom section. This causes the flaps of the sections to pivot away from the bottom section of the blank and generates an interior of the box. Next, one generates the insert from the insert section and inserts the insert into the interior of the box. Thus, one can quickly and easily generate the box from the intermediate box assembly.

DETAILED DESCRIPTION

Figure 1:
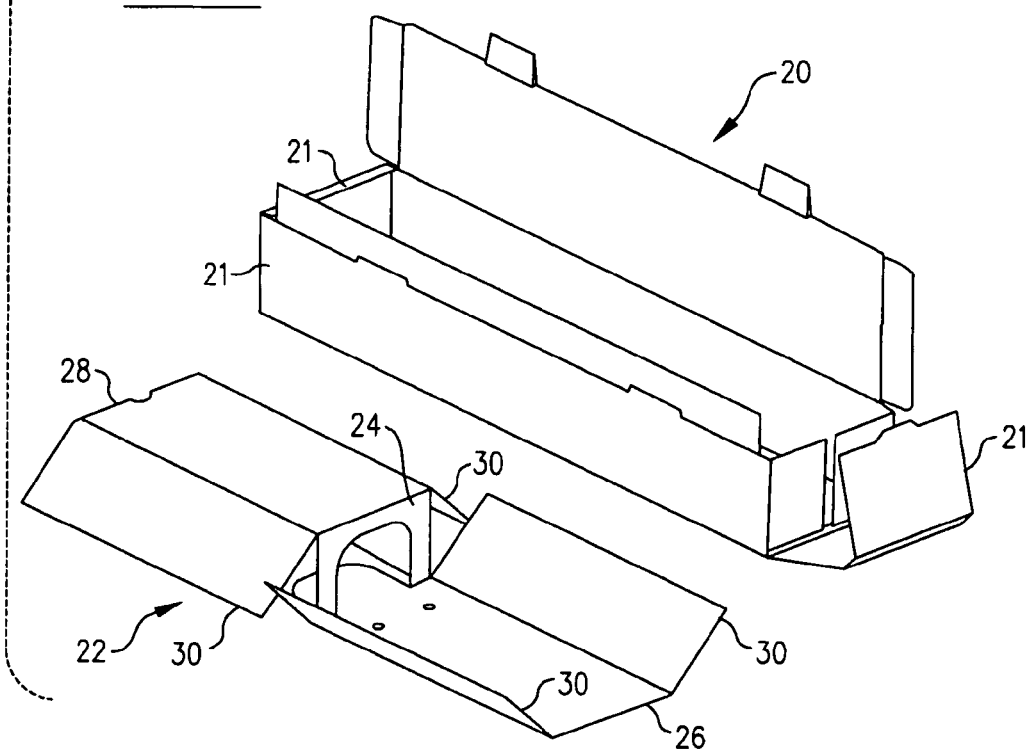
FIG. 1 PRIOR ART
FIG. 1 is a perspective view of a conventional flower box with a separate conventional insert that is inserted into the conventional box.
Figure 2:
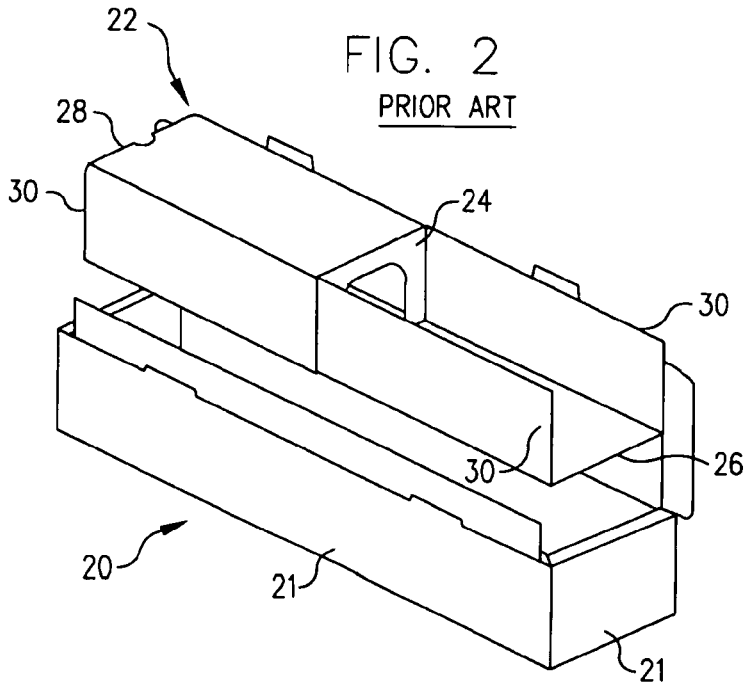
FIG. 2 PRIOR ART
FIG. 2 is a perspective view of the conventional flower box in FIG.1 receiving the conventional insert in FIG. 1.

All terms used herein, including those specifically described below in this section, are used in accordance with their ordinary meanings unless the context or definition indicates otherwise. Also, unless indicated otherwise, except within the claims, the use of "or" includes "and" and vice-versa. Non-limiting terms are not to be construed as limiting unless expressly stated (for example, "including" and "comprising" mean "including without limitation" unless expressly stated otherwise).

The invention provides boxes and methods that allow one to quickly and easily package flowers and accessories for shipment to a consumer without bending, bruising or otherwise damaging the flowers. In addition, the invention provides blanks and methods that allow one to quickly and easily generate the boxes and that ensure all of the components of the boxes will be available for properly packaging the flowers and accessories for shipment. Also, the invention provides intermediate box assemblies that are generated from the blanks and can be easily bundled together for shipment to or storage by the florist. These intermediate box assemblies eliminate most of the time consuming work performed by the packager of the flowers in generating the box before placing the flowers and accessories in the box. These intermediate box assemblies also eliminate one's need to keep track of two sets of inventory relating to the two conventional, separate components of the box—the box and the insert. Consequently, one can quickly and easily generate a box that can protect the flowers from the accessories during shipment and that can allow one to package the flowers without bending, bruising or otherwise damaging the flowers.

The boxes include a plurality of sides and a bottom that are connected to each other to define an interior, and an insert that extends from at least one of the sides or bottom. The blanks include at least two side sections and a bottom section connected to each other and an insert section that extends from one of the side or bottom sections. With the insert and insert section extending from one of the sides or bottom of the box, or one of the side or bottom sections of the blank, respectively, the insert or insert section is retained to the respective box or blank. This eliminates the need to keep track of two sets of inventory and greatly reduces the possibility of not being able to generate a box because either component—the insert or the box—is missing. The insert includes a divider that can extend from one of the sides of the box to another side to divide the interior into two or more compartments when the insert is inserted into the interior. Typically, one compartment contains the fragile flower portion of the flowers, while another compartment contains the less fragile stem portion of the flowers and the accessories. Thus, the fragile flower portions of the flowers are protected during shipment. The divider is typically attached to one or more of the sides after the flowers have been placed in the interior of the box. Thus, one can package the flowers in the box without bending, bruising or otherwise damaging the flowers.

Figure 3:
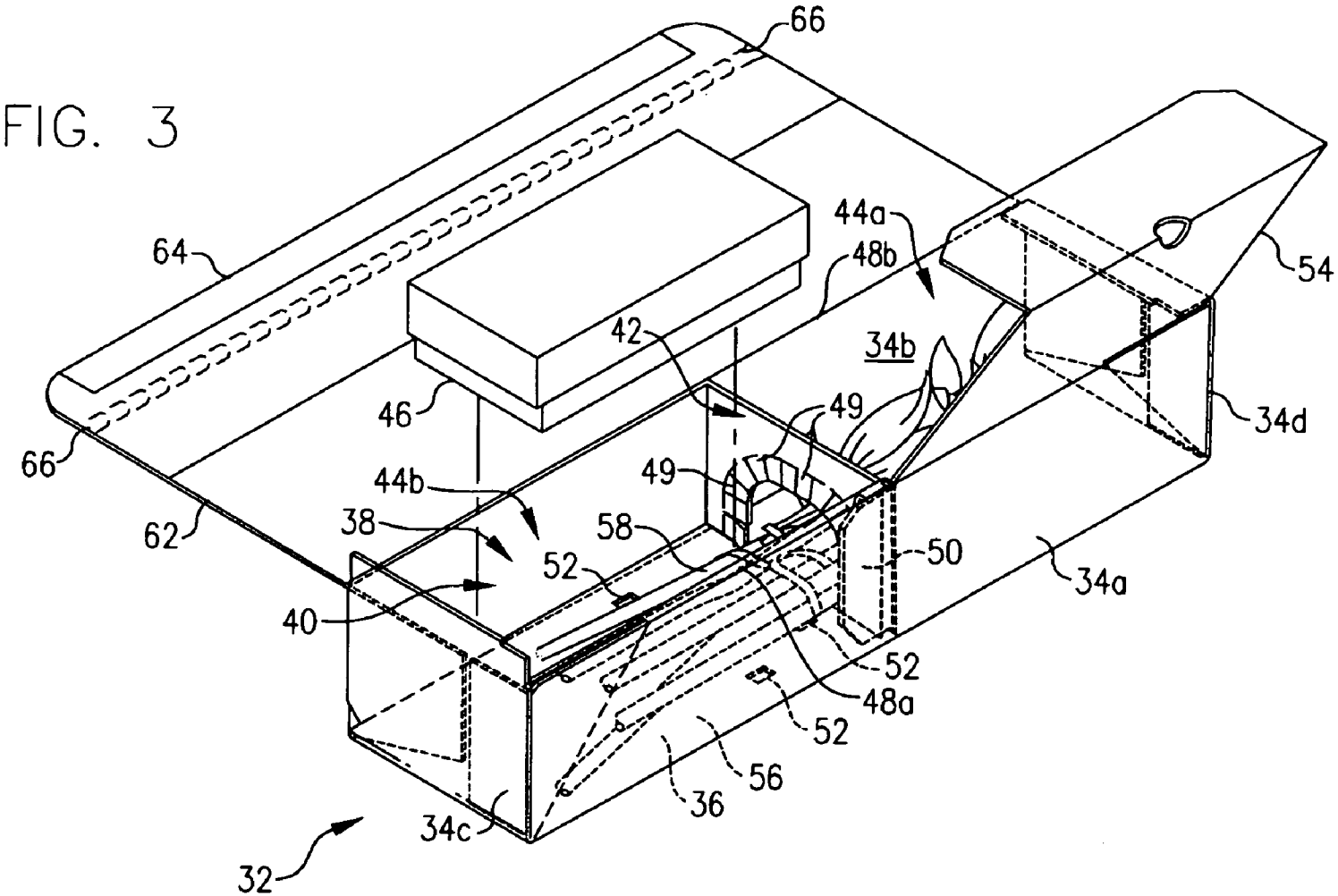
FIG. 3 is a perspective view of a box according to an embodiment of the invention.
Figure 4:
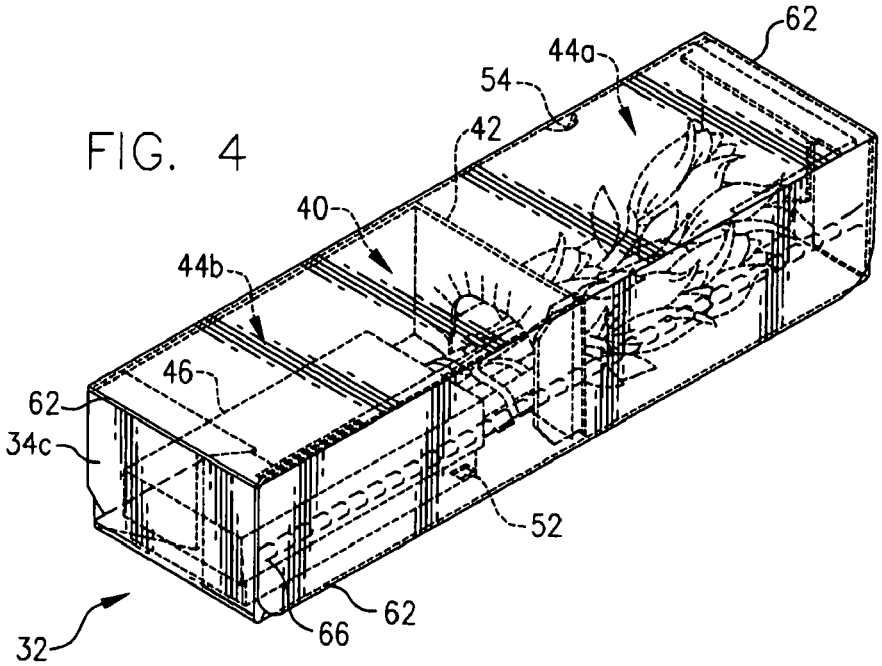
FIG. 4 is a perspective view of the box in FIG. 3 closed and ready for shipping according to an embodiment of the invention.
Figure 14:
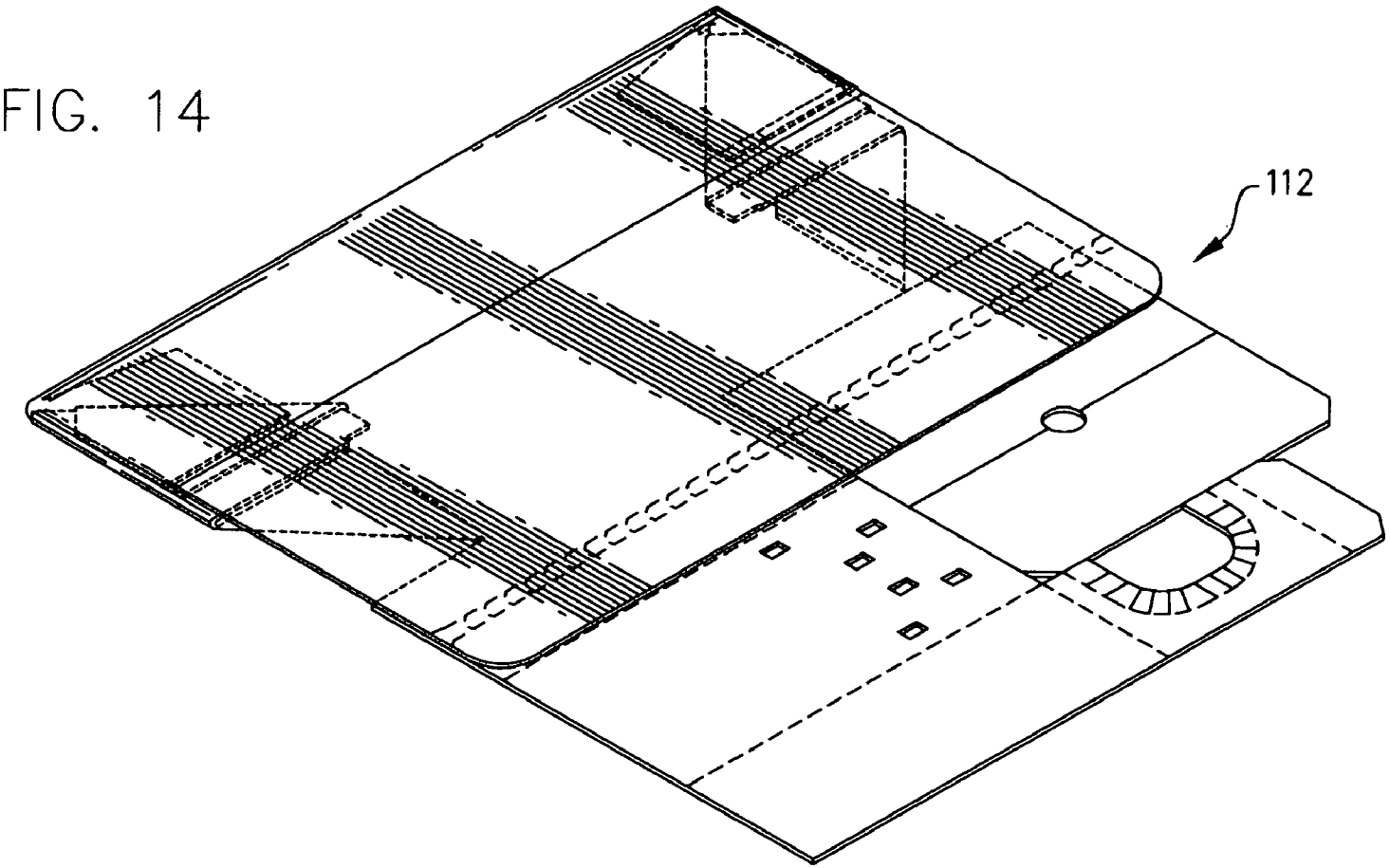
FIG. 14 is a perspective view of an intermediate box assembly formed by the method illustrated in FIGS. 10–13 according to an embodiment of the invention.
Figure 15:
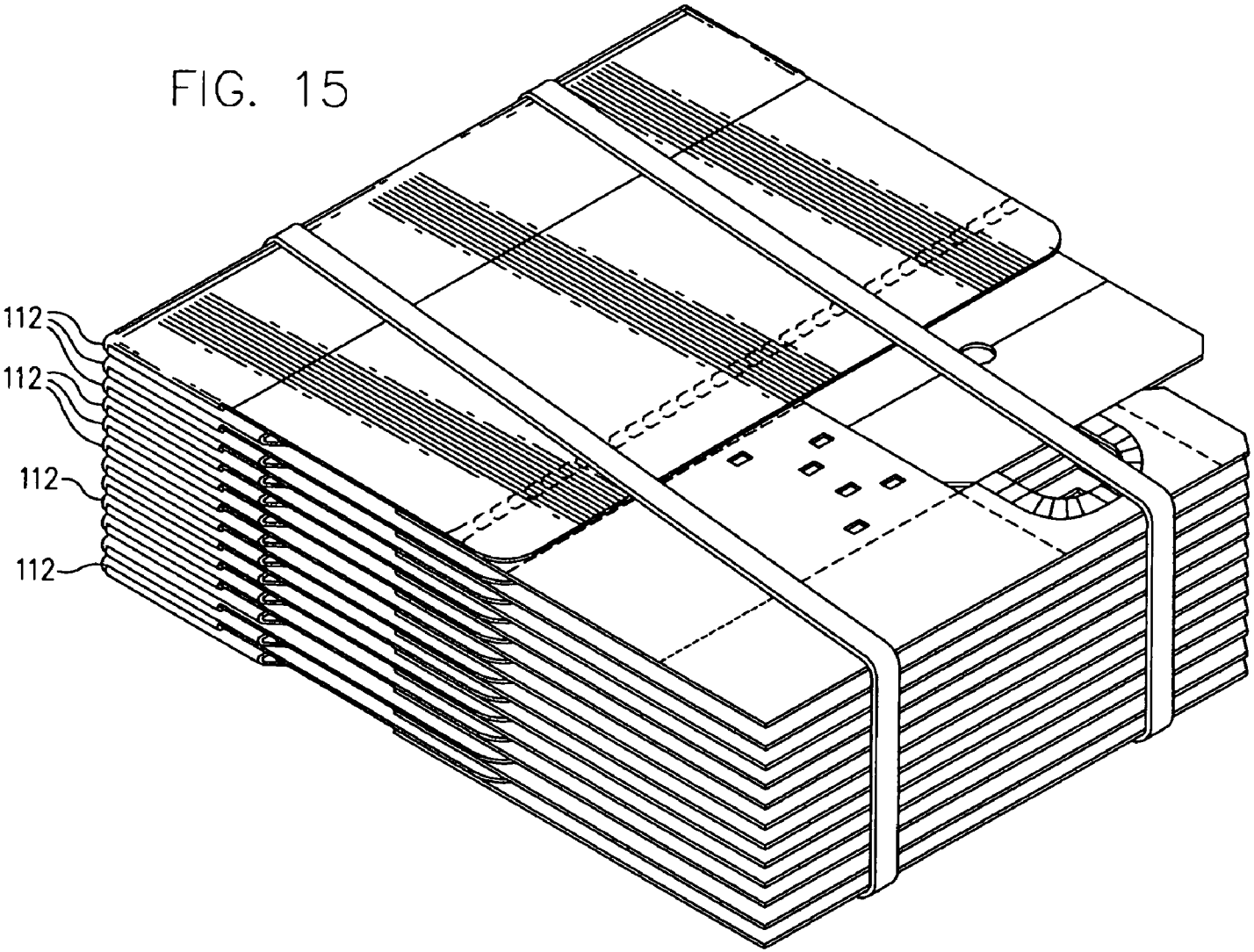
FIG. 15 is a perspective view of multiple intermediate box assemblies like the assembly in FIG. 14 bundled for shipping or storing.
Figure 16:
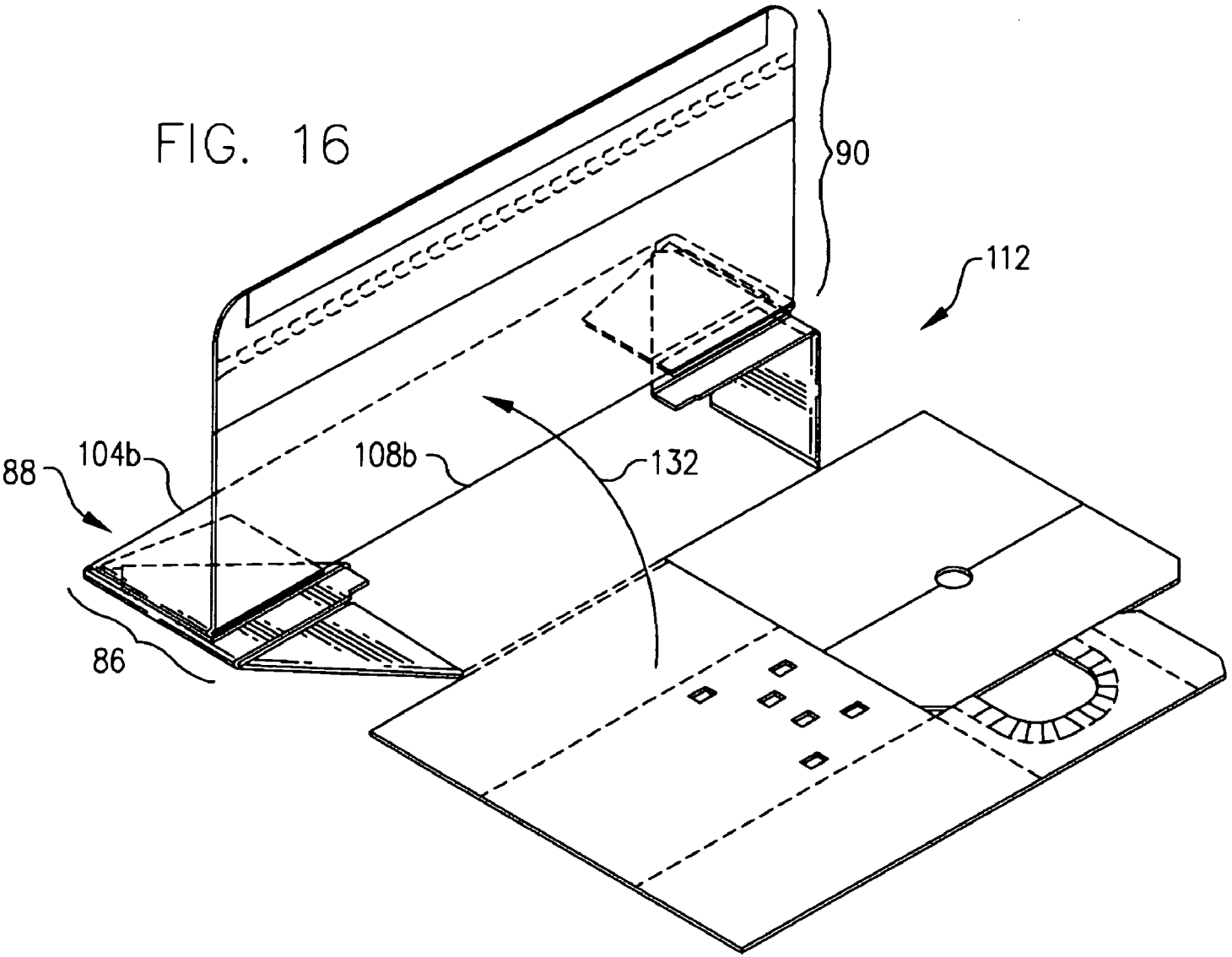
FIG. 16 is a perspective view of the intermediate box assembly in FIG. 14 showing a first step in forming the intermediate box assembly into the box of FIGS. 3–5 according to an embodiment of the invention.
Figure 17:
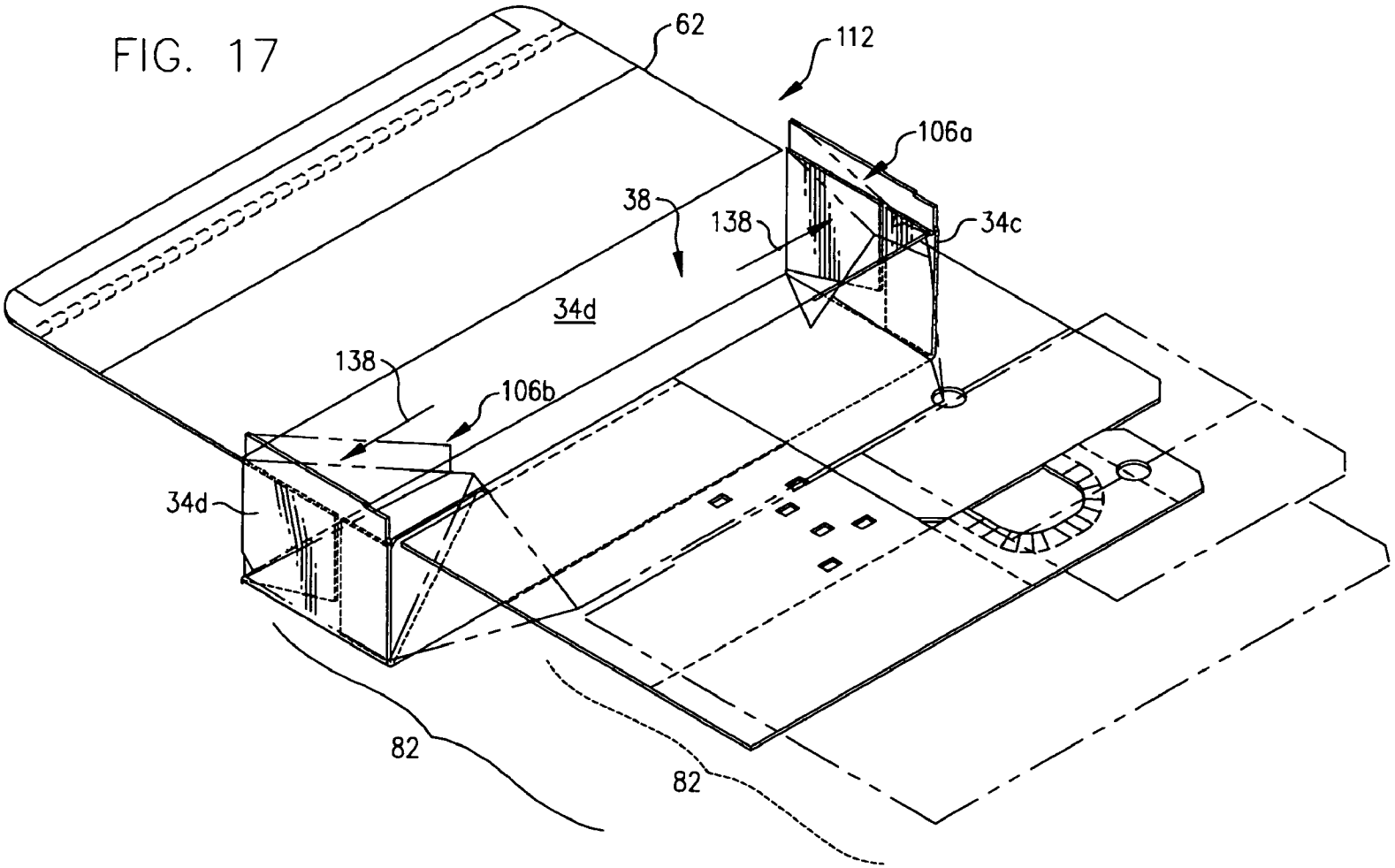
FIG. 17 is a perspective view of the intermediate box assembly in FIG. 16 showing a next step in forming the intermediate box assembly into the box of FIGS. 3–5 according to an embodiment of the invention.

FIGS. 3 and 4 illustrate a box according to an embodiment of the invention. FIGS. 5–8 illustrate the box of FIGS. 3 and 4 and a method of inserting the insert and flowers into the interior of the box and then dividing the interior into two compartments. FIG. 9 illustrates a blank that can easily generate the box of FIGS. 3 and 4 according to an embodiment of the invention. FIGS. 10–13 illustrate the blank of FIG. 9 and a method of generating an intermediate box assembly according to an embodiment of the invention. FIGS. 14 and 15 illustrate an intermediate box assembly according to an embodiment of the invention. And FIGS. 16 and 17 illustrate a method of generating the box of FIGS. 3–5 from the intermediate box assembly according to an embodiment of the invention.

FIGS. 3 and 4 are perspective views of a box 32 according to an embodiment of the invention. The box 32 can be made of any desirable material such as cardboard, corrugated cardboard, particle board, plastic, resilient rubber, or any other desired material, and the box 32 can be generated from the blank 80 shown and discussed in greater detail elsewhere herein or by any desired conventional technique. In this and certain other embodiments, the box 32 includes four sides 34*a*–34*d*, that include a first side 34*a*, a second side 34*b* and a bottom 36 that are connected to each other and define a rectangular interior 38. The box 32 also includes an insert 40 that extends from the first side 34*a* and is inserted into the interior 38 by pivoting the insert 40 relative to the first side 34*a*. The insert 40 includes a divider 42 that extends from the insert 40 toward the first side 34*a* and is attached to the first side 34*a*. By extending between the first and second sides 34*a* and 34*b*, the divider 42 divides the interior 38 into two compartments 44*a* and 44*b* that have equal or substantially equal volumes. The flower portions of the flowers are typically contained in the compartment 44*a* while the stems and accessories box 46 are contained in the compartment 44*b*. Thus, the accessories box is substantially prevented from bruising or otherwise damaging the fragile flower portions contained in the compartment 44*a*.

In this and certain other embodiments, the compartments 44*a* and 44*b* have equal or substantially equal volumes but in other embodiments, the compartments can have volumes that are not substantially equal. For example, if the flowers to be packaged and shipped include flower portions that are concentrated on ends of the flowers, then the compartment 44*a* can have a volume that is less than the volume of the compartment 44*b*. Or, if the flowers include large flower portions and small stem portions, then the compartment 44*a* can have a volume more than the volume of the compartment 44*b*. In addition, the compartment 44*a* can be located anywhere in the interior 38. For example, the compartment 44*a* can be located at either end of the interior 38 or the compartment 44*a* can be located in the middle of the interior 38 with the compartment 44*b* located at at least one end of the interior 38.

Still referring to FIGS. 3 and 4, the insert 40 can extend from any desired location on the sides 34*a*–34*b* or the bottom 36. In this and certain other embodiments, the insert 40 extends from a top end 48*a* of the first side 34*a*. But in other embodiments, the insert 40 may extend from the top end 48*b* of the second side 34*b* or the insert 40 may extend from any location on the bottom 36. For example, the insert 40 can extend from the corner where the bottom 36 and first side 34*a* meet or the corner where the bottom 36 and the second side 34*b* meet. Furthermore, in this and certain other embodiments, the insert 40 is integral to the first side 34*a* that it extends from. In other embodiments, however, the insert 40 can be attached to the top end 48*a* of the first side 34*a* by any desired conventional technique gluing, stitching, stapling, or any desired mechanical fastening technique.

Still referring to FIGS. 3 and 4, the insert 40 includes a divider 42 that is shaped to permit the stem portion of the flowers to extend into the compartment 44*b* while preventing the accessories box or other items contained in the compartment 44*b* from entering the compartment 44*a*. In addition, the divider 42 can be attached to one of the sides 34*a*–34*b* after the flowers have been placed in the interior 38 of the box 32. In this and certain other embodiments, the divider 42 includes a plurality of flexible fingers 49 that extend from the divider 42 and allow one to use the same or substantially same divider 42 to package different quantities of flowers. Thus, the box can have one standard insert that can be used to ship different quantities of flowers. In addition, the divider 42 is shaped like an upside down "U" and has the same or approximately the same height as the first and second sides 34*a* and 34*b*. In other embodiments, the divider 42 can have any desired shape that permits the stem portions to extend into the compartment 44*b* while preventing other items contained in the compartment 44*b* from entering the compartment 44*a*, such as an upside down "W", and can have a height different that the first and second sides 34*a* and 34*b*. To divide the interior 38 into the compartments 44*a* and 44*b* and protect the flower portions contained in the compartment 44*a*, the divider 42 extends between the first and second sides 34*a* and 34*b* and can be attached to the side 34*a* by inserting a divider end 50 between the insert 40 and the side 34*a*. In other embodiments, the divider 42 can extend between other sides such as 34*c* and 34*d*, or 34*a* and either 34*c* or 34*d*, or 34*b* and either 34*c* and 34*d*. In addition, the divider 42 can be attached to any of the sides 34*a*–34*b* using conventional fasteners such as Velcro®, snaps, string or wire, or by any desired fastening technique.

Still referring to FIGS. 3 and 4, the insert 40 can also include tie-down holes 52 that can be used to help retain the flowers in the interior 38 and an insert top 54 that can cover the compartment 44*a* to help protect the flower portions contained in the compartment 44*a*. In this and certain other embodiments, six tie-down holes 52 (three tie-down holes shown) are located in an insert bottom 56 at various distances between each other and the divider 42 to accommodate different flower sizes and different quantities of flowers that can be contained in the box 32. To tie down the flowers in the box 32, a metal wire 58 is threaded through two of the tie-down holes 52 and wrapped around the stem portions of the flowers. The ends 60 of the metal wire 58 are then tied together to retain the flowers to the insert bottom 56. In other embodiments, string made of any desired material or plastic ties or straps with adjustable latches can be used to tie down the flowers in the box 32. In this and certain other embodiments, the insert top 54 typically extends from the top end 48*a* of the first side 34*a* and is pivoted relative to the first side 34*a* to cover the compartment 44*a* as desired. That is, the insert top 54 can be pivoted or remain un-pivoted relative to the first side 34*a* irrespective of whether or not the insert 40 is inserted into the interior region 38. In other embodiments, the insert top 54 may only cover a portion of the compartment 44*a* as desired.

Still referring to FIGS. 3 and 4, the box 32 can also include a top that covers the interior region 38 of the box, and thus both compartments 44*a* and 44*b*, to protect the flowers and accessories during shipment. In this and certain other embodiments, the top extends from the top end 48*b* of the second side 34*b* and is integral to the second side 34*b*. But in other embodiments, the top 62 can extend from the top end 48*a* of the first side 34*a* or the top 62 can extend from the sides 34*c* and 34*d* or any location on the bottom 36. Furthermore, in other embodiments, the top 62 can be attached to the top end 48*b* by any desired conventional technique such as gluing, stitching, stapling, or any other desired mechanical fastening technique. The top 62 is also sized to cover the interior region 38 and to contact the outer surface of the second side 34*b*—the surface outside the interior 38—when the top 62 is pivoted toward the interior 38 to close the box 32.

Still referring to FIGS. 3 and 4, to keep the box 32 closed during shipment, the top 62 includes and attachment strip 64 that substantially extends the width of the top 62. The attachment strip 64 can be made of any desired adhesive or composite of any adhesive and any other desired material. For example, the attachment strip 64 can be double sided tape with one side adhering to the top 62 and a film adhering to the other side that, before attaching the attachment strip 64 to the first side 34*a*, must be peeled away. In other embodiments, the attachment strip 64 can be made of any water or other chemically activated adhesive.

Still referring to FIGS. 3 and 4, to open the box 32, after the attachment strip 64 has been attached to the first side 34*a*, the top 62 includes a tear strip 66 that also extends the width of the top 62 and is located between the attachment strip 64 and the top end 48*b* of the second side 34*b*. The tear strip 66 can be made by any desired technique that allows the tear strip 66 to be easily removed from the top 62 and yet retain the attachment strip 64 to the top 62 when the tear strip 66 is not removed. For example, the tear strip 66 can be made by perforating a section of the top 62. In other embodiments, the tear strip 66 can be a cord or thread that removably stitches the attachment strip 64 to the top 62 such that when the cord or thread is pulled the stitching unravels and the attachment strip 64 is removed from the top 62.

Although the box 32 in FIGS. 3 and 4 is shown and described as a rectangular box, the box 32 can have any desired number of sides such as three, five or six.

FIGS. 5–8 illustrate the box 32 of FIGS. 3 and 4 and a method of inserting the insert and flowers into the interior 38 of the box 32 and then dividing the interior 38 into two compartments 44*a* and 44*b* with the divider 42. With this method, one can quickly and easily insert the insert 40 into the interior 38 of the box 32 and package flowers in the box 32 without bending, bruising or otherwise damaging the flowers.

Figure 5:
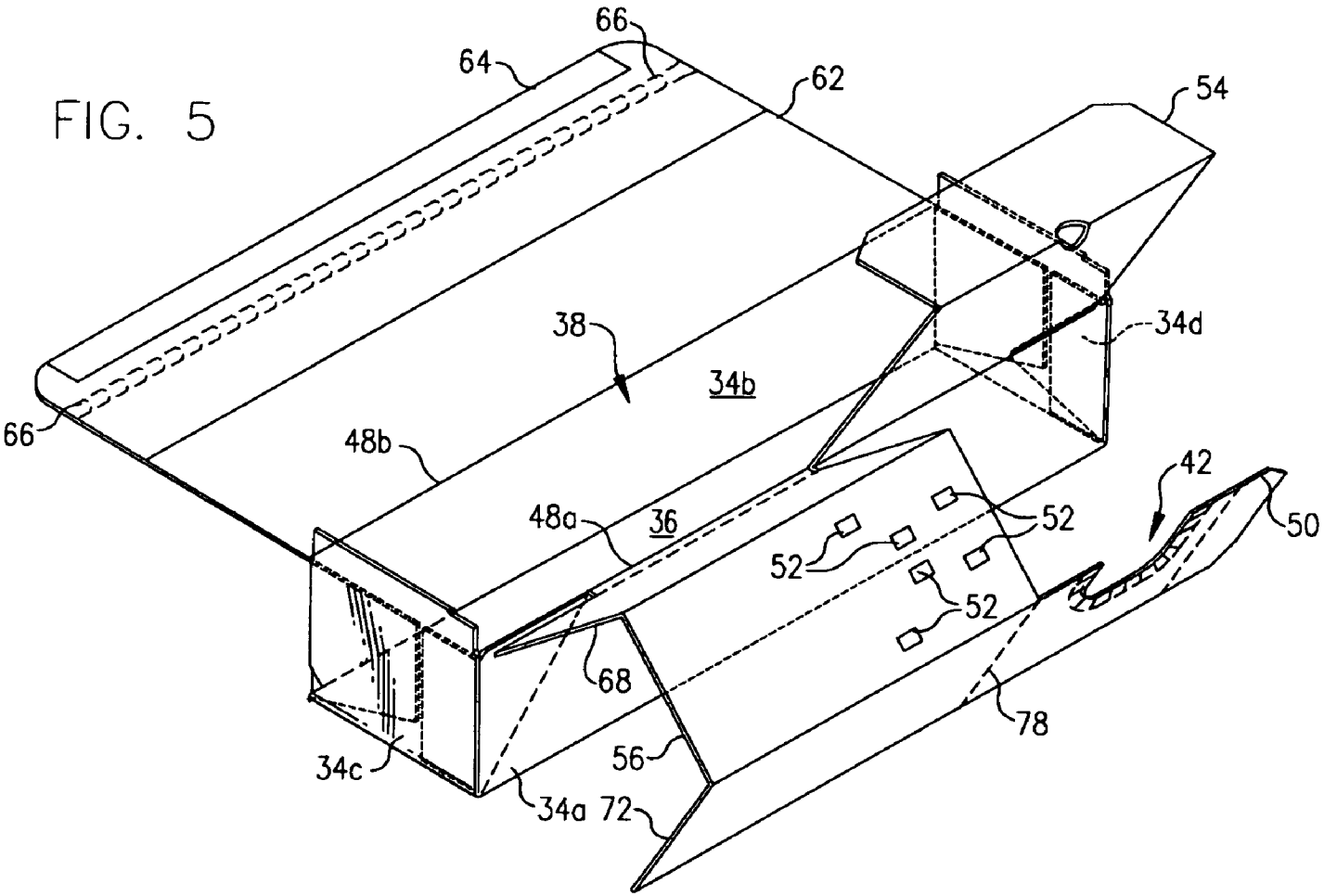
FIG. 5 is a perspective view of the box in FIGS. 3 and 4 before inserting an insert according to an embodiment of the invention.

Referring to FIG. 5, in this and certain other embodiments, one first threads a metal wire 58 through two or more of the tie-down holes 52, as discussed elsewhere herein. Then one pivots the insert 40 about the top end 48*a* of the first side 34*a* and toward the interior 38 to insert the insert 40 into the interior 38. When inserted, the insert 40 nests in the interior 38 between the sides 34*a* and 34*b* and the bottom 36. For example, the first insert side 68, the insert bottom 56 and the second insert side 72, each of the insert 40, can respectively contact the first side 34*a*, the bottom 36 and the second side 34*b*. The divider 42 does not extend between the sides 34*a* and 34*b* yet but rather is located adjacent the second side 34*b* or can also contact the second side 34*b*. With the divider in this position, one can place the flowers into the interior region 38 and against the insert bottom 56 and the bottom 36 of the box 32 without bending, bruising or otherwise damaging the flowers.

Figure 6:
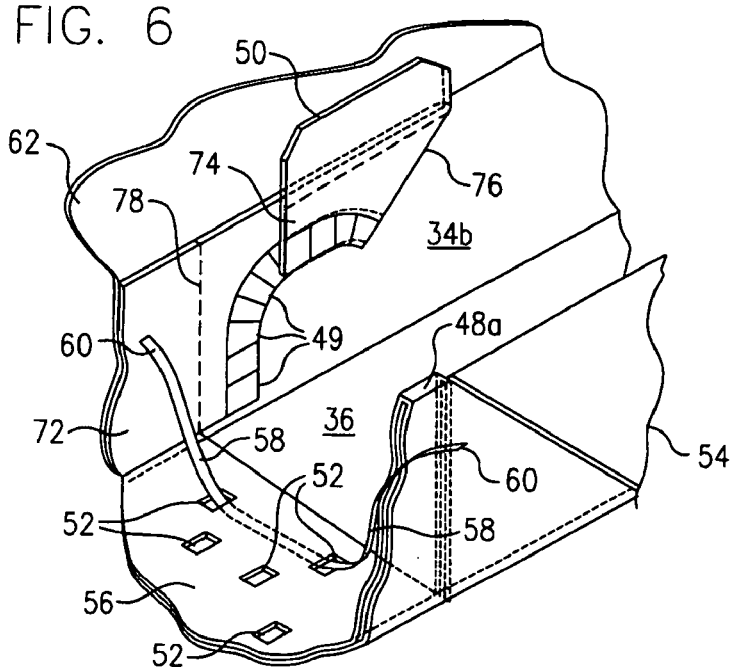
FIG. 6 is a partial perspective view of the box in FIGS. 3 and 4 showing a divider in the box before placing flowers in the box, according to an embodiment of the invention.

Referring to FIG. 6, in this and certain other embodiments, one next pivots a portion 74 of the divider 42 about a gate axis 76 and away from the bottom 36 of the box 32 to permit one to extend the divider between the first and second sides 34*a* and 34*b* after the flowers have been placed in the box 32. If the portion 74 of the divider 42 remained extended toward the bottom 36 of the box 32, one would not be able to pivot the divider 42 about the divider axis 78 to extend the divider 42 between the sides 34*a* and 34*b*. Consequently, the gate axis 76 can be located anywhere on the divider 42 that sufficiently moves the portion 74, when the portion 74 is pivoted, to permit the divider 42 to be pivoted about the divider axis 78 after the flowers are in the box 32.

Figure 7:
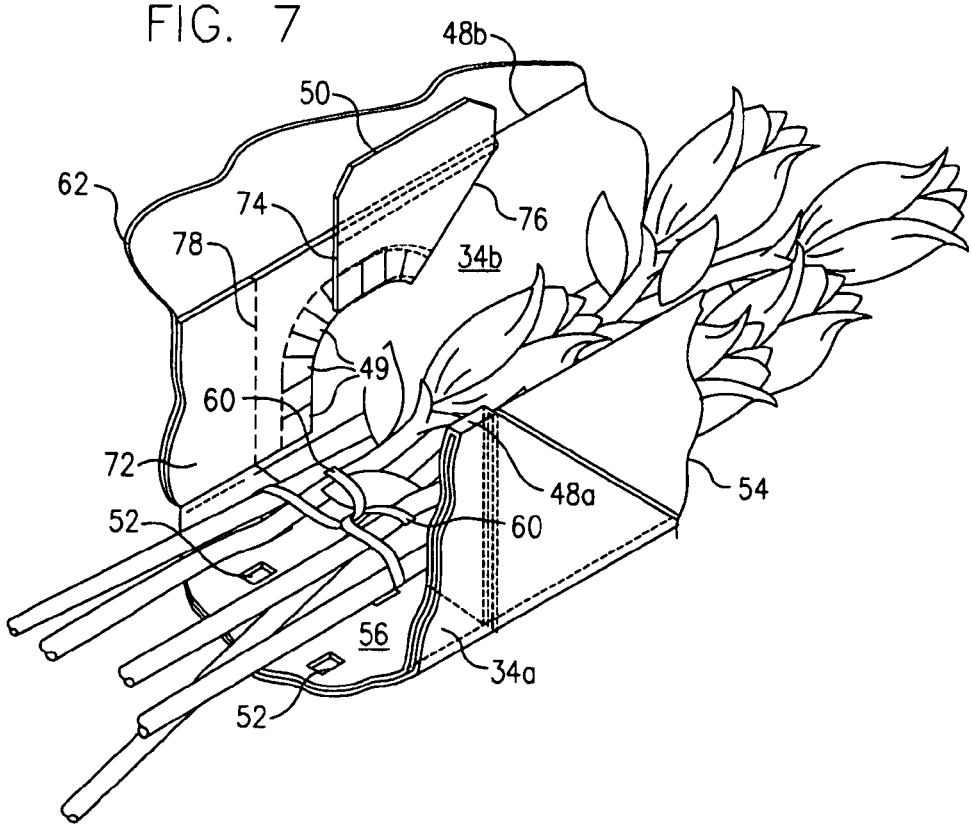
FIG. 7 is a partial perspective view of the box in FIGS. 3 and 4 showing a divider in the box after placing flowers in the box, according to an embodiment of the invention.

Referring to FIG. 7, in this and certain other embodiments, one next places the flowers against the insert bottom 56 and the bottom 36. With the divider 42 adjacent to or contacting the second sided 34*b*, the flowers can be inserted into the box 32 containing the insert 40 without bending, bruising or otherwise damaging the flowers. Next, one wraps the metal wire 58 around the stem portions of the flowers and twists the ends 60 of the metal wire 58 to retain the flowers to the insert bottom 56 and thus keep the flower portions of the flowers from bruising or otherwise damaging themselves during shipment.

Figure 8:
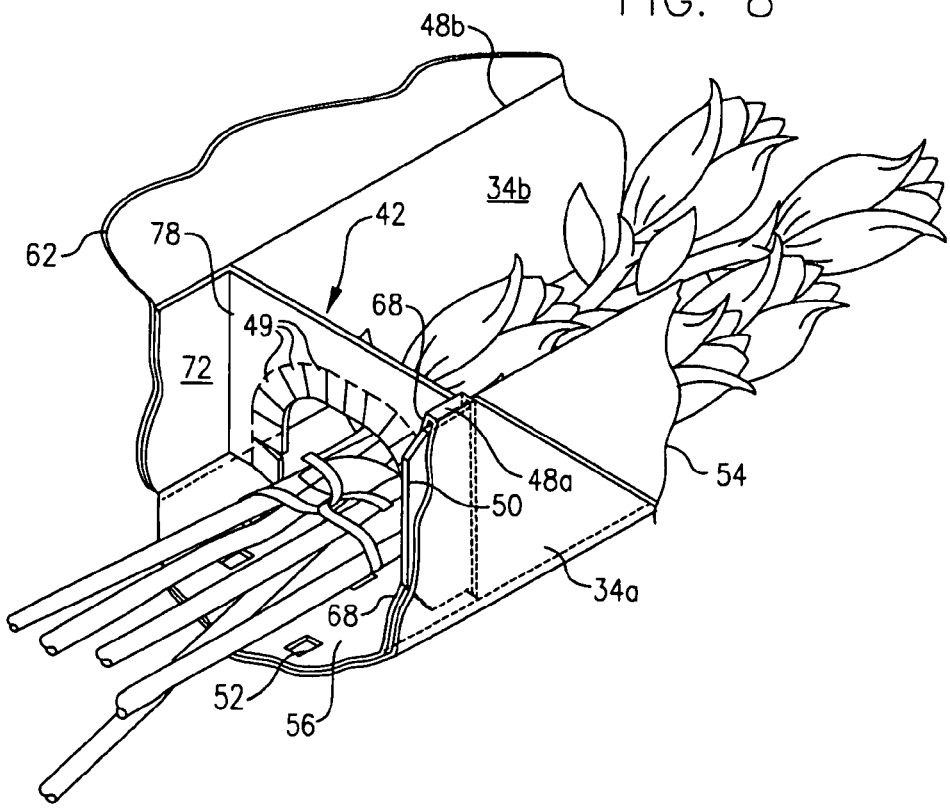
FIG. 8 is a partial perspective view of the box in FIGS. 3 and 4 showing a divider dividing the interior of the box into two compartments after placing the flowers in the box, according to an embodiment of the invention.
Figure 9:
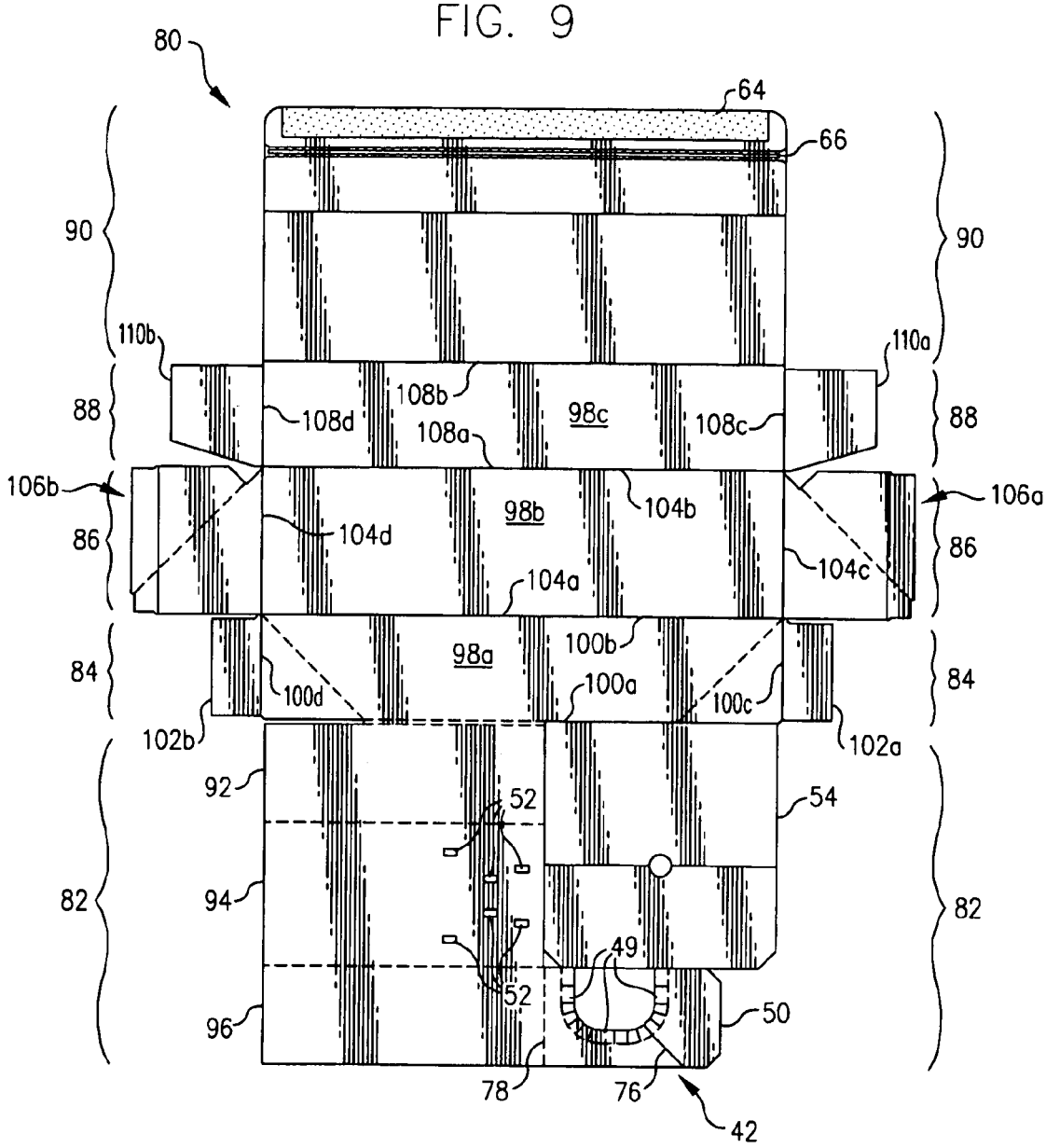
FIG. 9 is a plan view of a blank that can be formed into the box in FIGS. 3–5 according to an embodiment of the invention.

Referring to FIG. 8, in this and certain other embodiments, one pivots the divider 42 about the divider axis 78 and toward the first side 34*a* to extend the divider 42 between the sides 34*a* and 34*b* and divide the interior region 38 into two compartments 44*a* and 44*b*. Then to complete the extension of the divider 42 between the sides 34*a* and 34*b*, one pivots the portion 74 about the gate axis 76 and toward the bottom 36. Then one pivots the divider end 50 relative to the portion 74 and inserts the divider end 50 between the first insert side 68 and the first side 34*a* of the box 32 to attach the divider to the first side 34*a*. Thus, the divider 42 divides the interior region 38 into two compartments and can prevent the accessories (not shown) contained in the compartment 44*b* from bruising or otherwise damaging the flowers contained in the compartment 44*a*.

The invention also provides blanks and methods that allow one to quickly and easily generate the boxes and that ensure an insert will be available for properly packaging the flowers and accessories for shipment. The blanks include at least two side sections and a bottom section connected to each other that define an interior when the sections are pivoted relative to each other to form the box 32 of FIGS. 3–5. The blanks also include an insert section extending from one of the side sections and including at least two insert portions that can be pivoted relative to each other to generate an insert. When the insert and the interior defined by the side and bottom sections are generated, the insert can be inserted into the interior to prepare the box 32 of FIGS. 3–5 for packaging flowers and accessories. Thus, the blanks ensure that an insert will be available to protect the flowers during shipment in the generated box. The insert section also includes a divider that extends from one of the insert portions and that, when desired, can divide the interior into two compartments when the interior is generated.

FIG. 9 is a top view of a blank 80 that can be easily generated into the box 32 of FIGS. 3–5 according to an embodiment of the invention. In this and certain other embodiments, the blank 80 includes an insert section 82, a first side section 84, a bottom section 86, a second side section 88 and a top section 90 that are connected to each other by being integral to each other. But in other embodiments, the sections 82–90 can be connected to each other by any desired fastening technique such as fastening them together with stitches, adhesive, staples, or any other desired mechanical fasteners. More specifically, the insert section 82 extends from the first side section 84, and the first side section 84 is connected to the bottom section 86 opposite the insert section 82. Opposite the first side section 84, the second side section 88 is connected to the bottom section 86, and the top section 90 is connected to the second side section 88 opposite the bottom section 86. Thus, the insert section 82 corresponds to the insert 40 in FIGS. 3–5, and the sections 84–90 respectively correspond to the first side 34*a*, the bottom 36, the second side 34*b* and the top 62 of the box 32 in FIGS. 3–5.

Still referring to FIG. 9, in this and certain other embodiments, the insert section 82 includes a first insert-side portion 92 extending from the first side section 84, an insert-bottom portion 94 extending from the first insert-side portion 92 opposite the first side section 84, and a second insert-side portion 96 extending from the insert-bottom portion 94 opposite the first insert-side portion 92. These insert portions 92–96 respectively correspond to the first insert side 68 in FIGS. 3 and 4, the insert bottom 56 in FIGS. 3 and 4 and the second insert side 72 in FIGS. 3 and 4. The insert section 82 also includes the divider 42 in FIGS. 3–8 that extends from the second insert-side portion 96 and can be pivoted about the divider axis 78 to extend the insert 40 between the sides 34*a* and 34*b* as shown in FIGS. 3–8.

Still referring to FIG. 9, in this and certain other embodiments, the first side section 84 includes a first-side-section body 98*a* having a first, second, third and fourth first-side-section end, 100*a*–100*d*, respectively, and a first and second first-side-section flap 102*a* and 102*b* extending from the third and fourth first-side-section ends 102*c* and 102*d* respectively. The first first-side-section flap 102*a* can be pivoted about the third first-side-section end 100*c* while the second first-side-section flap 102*b* can be pivoted about the fourth first-side-section end 100*d* to combine with the flaps of the other sections 98*b* and 98*c*, discussed elsewhere herein, to form the sides 34*c* and 34*d* of the box 32 in FIGS. 3 and 4.

Still referring to FIG. 9, in this and certain other embodiments, the bottom section 86 includes a bottom-section body 98*b* having a first, second, third and fourth bottom-section end, 104*a*–104*d*, respectively, and a first and second bottom-section flap 106*a* and 106*b* extending from the third and fourth bottom-section ends 104*c* and 104*d*, respectively. The first bottom-section flap 106*a* can be pivoted about the third bottom-section end 104*c* while the second bottom-section flap 106*b* can be pivoted about the fourth bottom-section end 104*d* to combine with the flaps of the other sections 98*a* and 98*c*, discussed elsewhere herein, to form the sides 34*c* and 34*d* of the box 32 in FIGS. 3 and 4.

Still referring to FIG. 9, in this and certain other embodiments, the second side section 88 includes a second-side-section body 98*c* having a first, second, third and fourth second-side-section end, 108*a*–108*d*, respectively, and a first and second second-side-section flap 110*a* and 110*b* extending from the third and fourth second-side-section ends 108*c* and 108*d*, respectively. The first second-side-section flap 110*a* can be pivoted about the third second-side-section end 108*c* while the second second-side-section flap 108*b* can be pivoted about the fourth second-side-section end 104*d* to combine with the flaps of the other sections 98*a* and 98*b*, discussed elsewhere herein, to form the sides 34*c* and 34*d* of the box 32 in FIGS. 3 and 4.

Still referring to FIG. 9, in this and certain other embodiments, the sections 84–88, the insert portions 92–96, the divider 42 and the flaps 102*a* and 102*b*, 106*a* and 106*b*, and 110*a* and 110*b* of each section 84–88 are integral to the respective elements each extends from. In other embodiments, however, the sections 84–88, the insert portions 92–96, the divider 42 and the flaps 102*a* and 102*b*, 106*a* and 106*b*, and 110*a* and 110*b* of each section 84–88 can be attached to the respective elements each extends from by any desired fastening technique such as gluing, stitching, stapling, or any other desired mechanical fastening technique.

FIGS. 10–13, 16 and 17 are perspective views of the blank 80 of FIG. 9 and illustrate a method of generating the box 32 of FIGS. 3–5 from the blank 80 according to an embodiment of the invention. FIGS. 14 and 15 are perspective views of an intermediate box assembly that can be generated from the blank 80 by the method illustrated in FIGS. 10–13 and that can be used with the method illustrated in FIGS. 16 and 17 to quickly and easily generate the box 32. With these methods, one can generate an intermediate box assembly that can be easily bundled and shipped to or stored by one packaging the flowers for shipment. Then, when one needs to ship flowers to a customer, one can quickly and easily generate the box 32.

Figure 10:
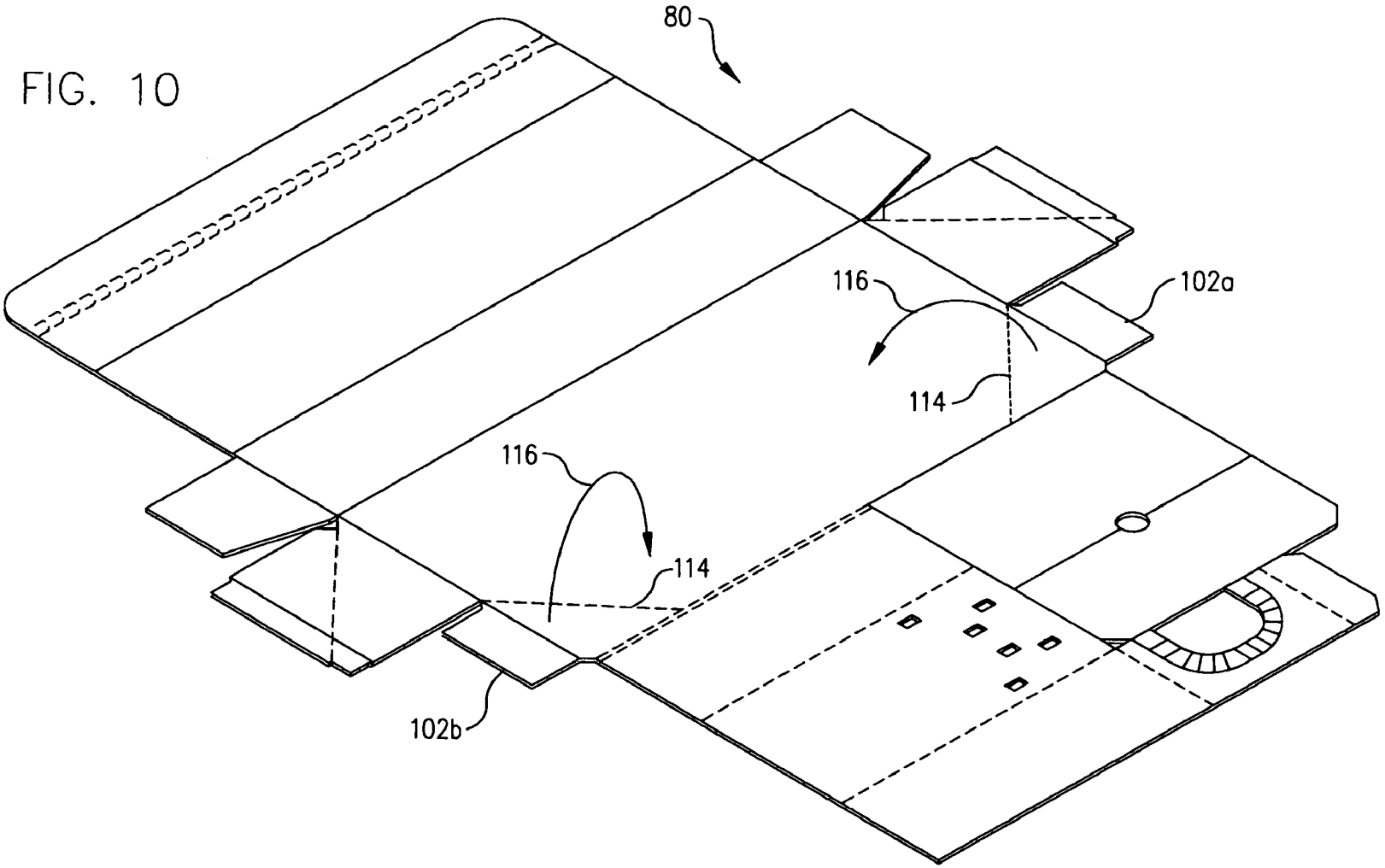
FIG. 10 is a perspective view of the blank in FIG. 9 showing a first step in forming the blank into the box of FIGS. 3–5 according to an embodiment of the invention.
Figure 11:
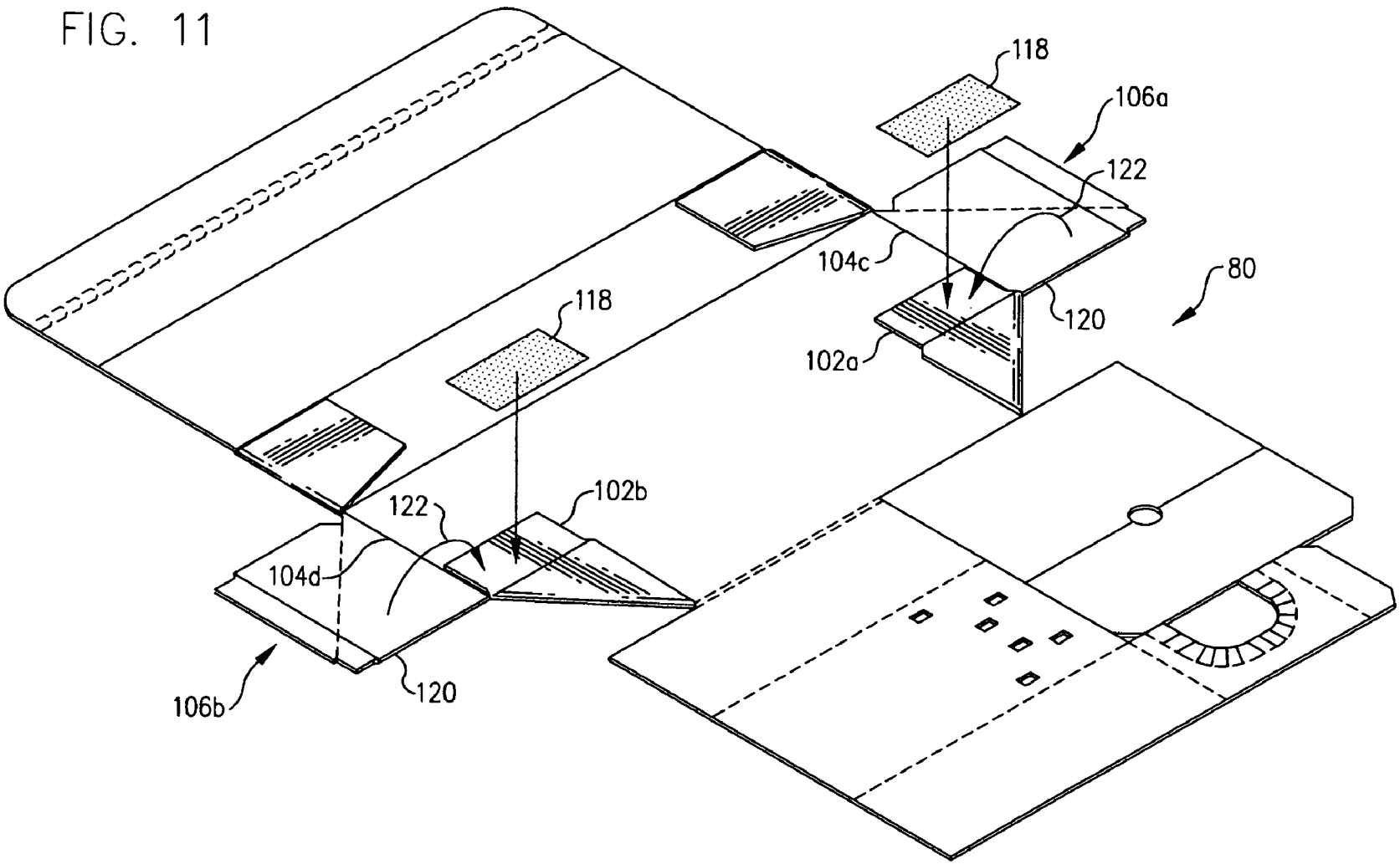
FIG. 11 is a perspective view of the blank in FIG. 10 showing a next step in forming the blank into the box of FIGS. 3–5 according to an embodiment of the invention.
Figure 12:
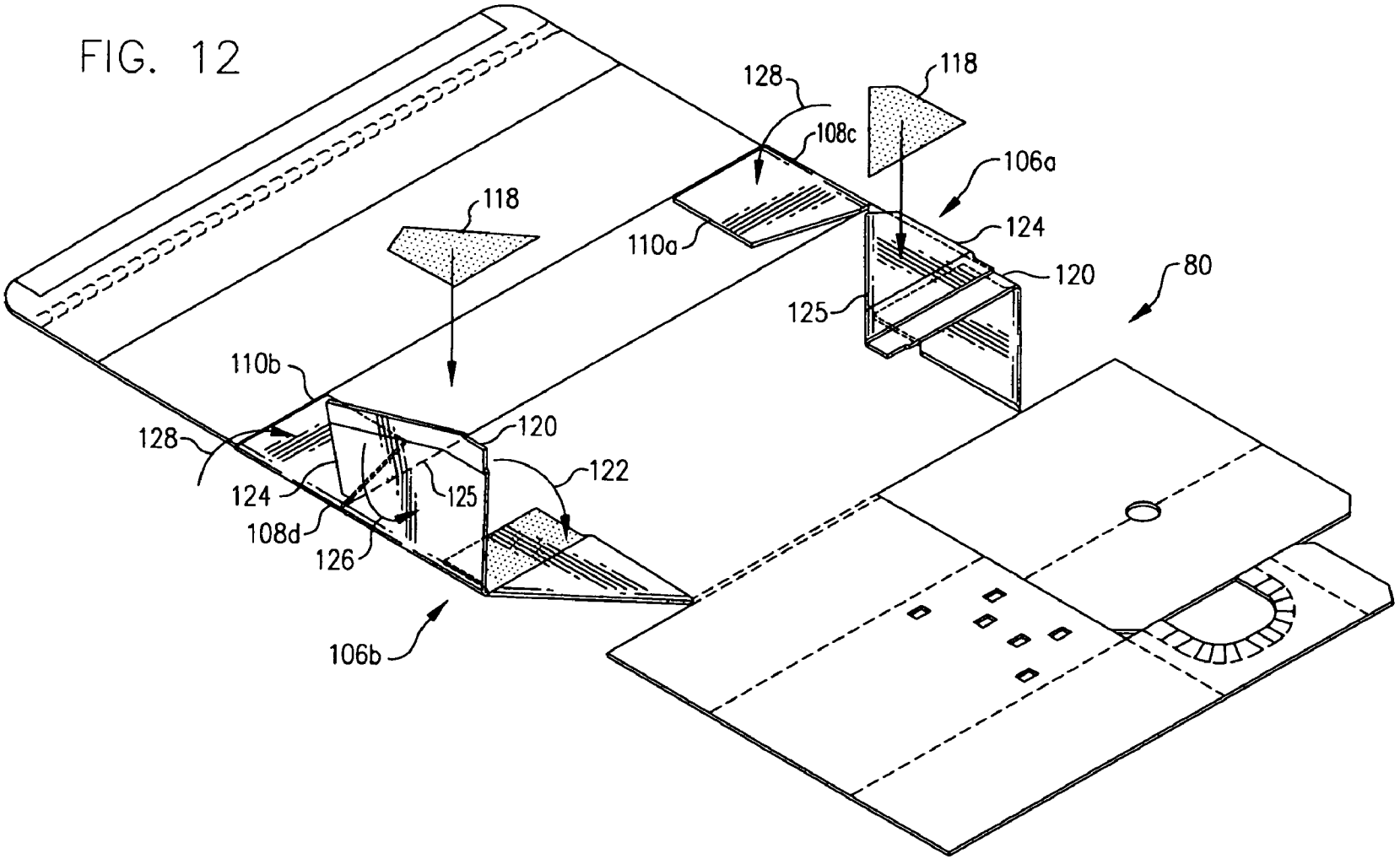
FIG. 12 is a perspective view of the blank in FIG. 11 showing a next step in forming the blank into the box of FIGS. 3–5 according to an embodiment of the invention.
Figure 13:
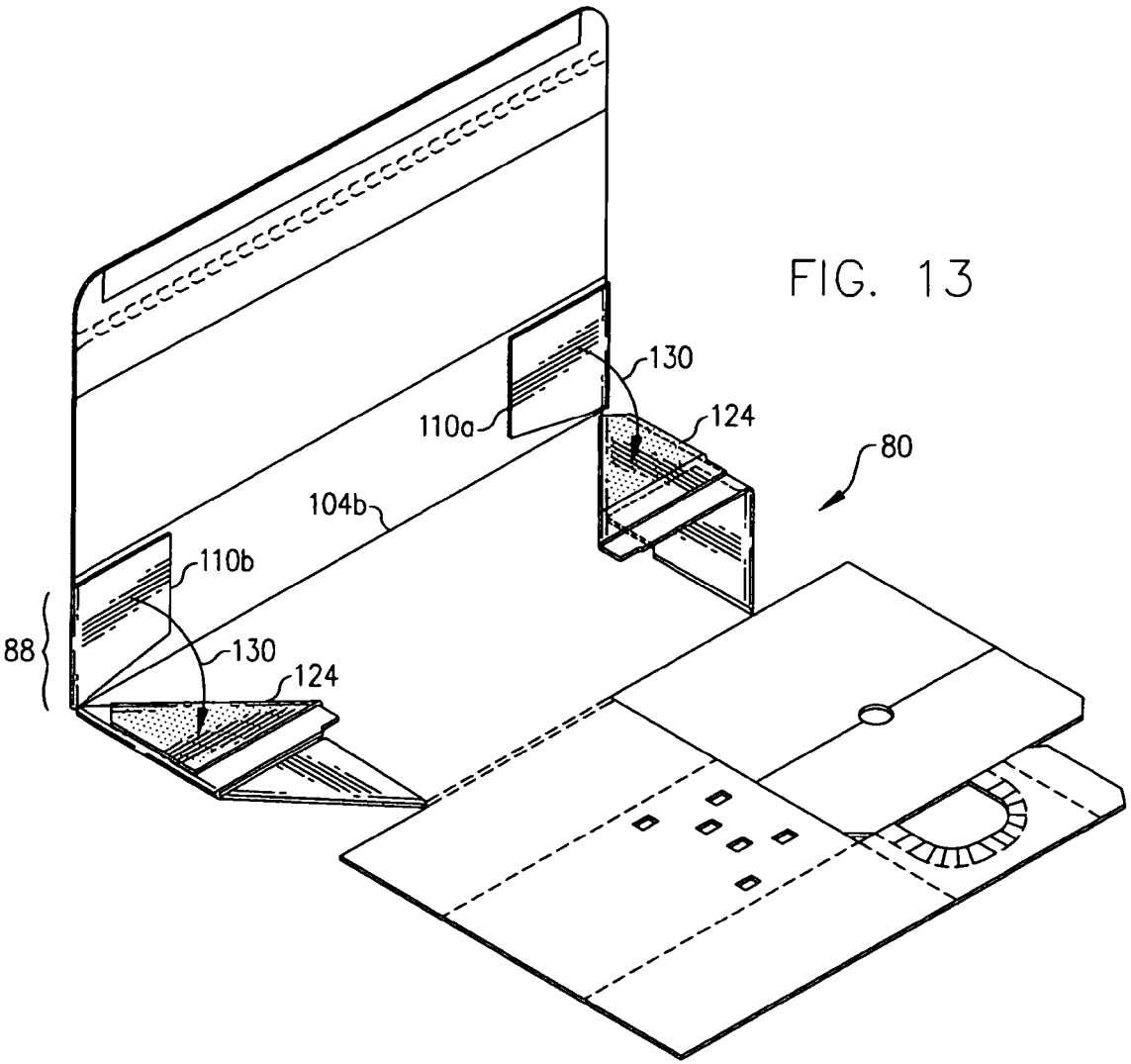
FIG. 13 is a perspective view of the blank in FIG. 12 showing a next step in forming the blank into the box of FIGS. 3–5 according to an embodiment of the invention.

Referring to FIGS. 10–13, the flaps 102*a* and 102*b*, 106*a* and 106*b*, and 110*a* and 110*b* are pivoted and then attached to each other to form an intermediate box assembly 112 shown in FIGS. 14 and 15. Referring to FIG. 10, in this and certain other embodiments, one first pivots each of the first and second first-side-section flaps 102*a* and 102*b* about a respective first-side-section axis 114 in the direction shown by the arrows 116. Then, referring to FIG. 11, one applies adhesive 118 on the first and second first-side-section flaps 102*a* and 102*b*. The adhesive 118 can be any desired conventional adhesive that will sufficiently attach the flaps 102*a* and 102*b*, 106*a* and 106*b*, and 110*a* and 110*b* together so that the box 32 can be generated and flowers contained in the box can be protected during shipment. Then, one attaches a first portion 120 of each of the first and second bottom-section flaps 106*a* and 106*b* to the first and second first-side-section flaps 102*a* and 102*b*, respectively, by pivoting each of the flaps 106*a* and 106*b* about the third and fourth bottom-section ends 104*c* and 104*d*, respectively, in the direction shown by the arrows 122. Then, referring to FIG. 12, one pivots a second portion 124 of each of the first and second bottom-section flaps 106*a* and 106*b* about a respective bottom-section-flap axis 125 in the direction of the arrow 126. Then, one applies adhesive 118 to the second portion 124 of each of the first and second bottom-section flaps 106*a* and 106*b*. Then, one pivots each of the first and second second-side-section flaps 110*a* and 110*b* about the third and fourth second-side-section ends 108*c* and 108*d*, respectively, in the direction shown by the arrows 128. Then, referring to FIG. 13, one pivots the second side section 88 about the second bottom-section end 104*b* in the direction shown by the arrows 130 and attaches the first and second second-side-section flaps 110*a* and 110*b* to respective second portions 124 so that the second side section 88 is parallel or substantially parallel to the bottom section 86.

Referring to FIGS. 14 and 15, thus, the intermediate box assembly 112 is generated from the blank 80 of FIG. 9. Typically, the method is performed by the manufacturer of the blank and can be quickly and easily executed with conventional automated box forming machinery. Thus, one no longer has to spend valuable time pivoting and gluing the sides of a convention blank to generate a conventional box. Furthermore, the intermediate box assembly 112 can be easily bundled as shown in FIG. 15 for shipment to or storage by one packaging the flowers for shipment because the intermediate box assembly 112 is flat or substantially flat. Then, when the florist needs to ship some flowers to a customer, he/she can easily generate the box 32 of FIGS. 3–5 by completing the method as illustrated in FIGS. 16 and 17.

Referring to FIGS. 16 and 17, one can generate the box 32 in FIGS. 3–5 from the intermediate box assembly 112 in FIGS. 14 and 15 quickly and easily. Referring to FIG. 16, in this and certain other embodiments, one pivots the top section 90 about the second second-side-section end 108*b* in the direction of the arrow 132 and gently pivots the second side section 88 about the second bottom-section end 104*b* and away from the bottom section 86. Referring to FIG. 17, because the first section flaps 102*a*, 106*a* and 110*a* are attached to each other and the second section flaps 102*b*, 106*b* and 110*b* are attached to each other, the sections 84–88 are urged to generate the sides 34*a*–34*d* and the bottom 36 that define a rectangular interior 38. To help generate the rectangular interior 38, one can push or pull the sides 34*c* and 34*d* in the direction shown by the arrows 138 away from the interior 38. With the generation of the interior 38, the insert 40 can be generated from the insert section 82 and inserted into the interior 38 to generate the box 32.

Although the box, blank, intermediate box assembly and methods for generating the box and intermediate box assembly and methods for using the box have been described in considerable detail with reference to certain embodiments for purposes of illustration, other embodiments are possible. Therefore the spirit and scope of the appended claims should not be limited to the above description of the embodiments; the present invention includes suitable modifications as well as all permutations and combinations of the subject matter set forth herein.

What is claimed is:

1. A box comprising:

a plurality of sides and a bottom connected to each other such that each side is connected to at least two other sides, and wherein the sides and bottom define an interior of the box;

a top extending from and selectively pivotable with respect to one of the sides between at least a first position in which the top closes the interior of the box and a second position in which the top opens the interior of the box; and an insert formed from a unitary body of material with the plurality of sides and pivotably connected to at least one of the sides, the insert extending from the at least one of the sides into the interior of the box and including a divider that extends between one of the sides and another of the sides, dividing the interior of the box into two or more compartments that are closed when the top is in the first position, the insert comprising a first side contiguous to a first side of the box, the first side of the insert having a first end in common with an end of the first side of the box, a bottom portion having a first end in common with a second end of the first side of the insert, opposing the first end, and contiguous to the bottom of the box, and a second side having a first end in common with a second end of the bottom portion of the insert, opposing the first end and contiguous to a second side of the box, wherein the divider extends from the second side of the box to the first side of the box, dividing the interior into two compartments that are closed when the top is in the first position, the divider including a divider end that is inserted between the first side of the insert and the first side of the box to retain the divider between the first and second sides of the box.

2. The box of claim 1 wherein the plurality of sides includes four sides that, with the bottom, define a rectangular interior.

3. The box of claim 1 wherein the top includes at least one of an adhesive strip operable to attach the top to the first side to keep the box closed and a tear strip removably coupled to the top and operable to open the box.

4. The box of claim 1 wherein the insert includes at least two tie-down holes in at least one insert side portion, the tie-down holes being adapted to receive two free ends of a tie member to assist in retaining the content of the box, the tie member being secured to the one insert side portion.

5. The box of claim 1 wherein the insert includes an insert top, extending from at least one of the first side, second sides, and divider, and selectively pivotable between at least a first position in which the insert top closes one of the two or more compartments and a second position in which the insert top opens the one of the two or more compartments, while the plurality of sides and the bottom continue to define the interior of the box.

6. The box of claim 1 wherein the divider divides the interior into two compartments having equal or substantially equal volumes and that are closed when the top is in the first position.

7. The box of claim 1 wherein the divider is the same or approximately the same height as at least one of the sides the divider extends between.

8. The box of claim 1 wherein the divider is shaped like an upside down "U" forming a U-shaped opening on a surface of the divider.

9. A blank that can be formed into a box comprising:

a plurality of box side sections, a box top section extending from one of the box side sections, and a box bottom section, the plurality of box side sections, the box top section and the box bottom section being formed from a unitary body of material, connected to each other and configured to define an interior when the sections are pivoted relative to each other, the box top section being selectively pivotable with respect to the one of the box side sections between at least a first position in which the box top section closes the interior of the box and a second position in which the box top section opens the interior of the box when the box is formed; and an insert section formed in the unitary body of material and configured to form an insert to be disposed within the interior of the box, the insert pivotably connected to a first box side sections, an insert first side section having a first end in common with an end of the first box side section, the insert first side section configured to position substantially parallel and substantially adjacent the first box side section when the insert is disposed within the interior of the box, an insert bottom section having a first end in common with a second end of the first insert side section, the insert bottom section configured to position substantially adjacent and substantially parallel a box bottom section when the insert is disposed within the interior of the box, an insert second side section having a first end in common with a second end of the insert bottom section, the insert second side section configured to position substantially adjacent and substantially parallel a box second side section when the insert is disposed within the interior of the box, and an insert divider extending from the insert second side section from a first position proximate the second box side section to a second position proximate the first box side section, dividing the interior of the box into at least two compartments, when the box and insert are formed.

10. The blank of claim 9 wherein the divider is configured to form a gate and a gate axis, a portion of the divider being operable to pivot about the gate axis to temporarily widen the gate for receiving a content of the box, the divider having a divider end adapted to retain a shape of the divider when the box is formed, the gate being adjacent at least one box side section, the at least one box side section forming a boundary of the gate, and the divider dividing the interior of the box into two or more compartments that are closed when the box is formed and the box top section is in the first position.

11. The blank of claim 9, further comprising:

an insert top section formed in the unitary body of material, the insert top section being pivotably connected to the insert, and when the box is formed, the insert top section being selectively pivotable between at least a first position in which the insert top section closes one of the at least two compartments and a second position in which the insert top section opens the one of the at least two compartments, while the plurality of box sides sections and the box bottom section continue to define the interior of the box.

12. The blank of claim 10 wherein:

the box bottom section includes a first bottom-section flap extending from a third bottom-section end and a second bottom-section flap extending from a fourth bottom-section end opposite the third bottom-section end;

the first box side section includes a first first-side-section flap extending from a third first-side-section end and a second first-side-section flap extending from a fourth first-side-section end;

the second box side section includes a first second-side-section flap extending from a third second-side-section end and a second second-side-section flap extending from a fourth second-side-section end; and wherein each flap is pivotable about one of the respective box section ends and the first bottom-section flap, first first-side-section flap and first second-side-section flap can be attached to each other, and the second bottom-section flap, second first-side-section flap and second second-side-section flap can be attached to each other.

13. A box comprising:

A plurality of box sides and a box bottom connected to each other such that each box side is connected to at least two other box sides, and wherein the box sides and box bottom define an interior of the box;

an insert formed from a unitary body of material with the plurality of box sides and pivotably connected to a first box side, the insert comprising:

an insert first side having a first end in common with an end of the first box side, the insert first side being substantially parallel and substantially adjacent the first box side when the insert is disposed within the interior of the box, an insert bottom having a first end in common with a second end of the first insert side, the insert bottom being substantially adjacent and substantially parallel the box bottom when the insert is disposed within the interior of the box, an insert second side having a first end in common with a second end of the insert bottom, the insert second side being substantially adjacent and substantially parallel the box second side when the insert is disposed within the interior of the box, and an insert divider extending from the insert second side from a first position proximate the second box side to a second position proximate the first box side so as to divide the interior of the box into at least two compartments; and a box top extending from and selectively pivotable with respect to one of the box sides between at least a first position in which the box top closes the interior of the box and a second position in which the box top opens the interior of the box.

14. The box of claim 13 wherein the insert includes at least two tie-down holes in at least one insert side, the tie-down holes being adapted to receive two free ends of a tie member to assist in retaining the content of the box, the tie member being secured to the one insert side.

15. The box of claim 13 wherein the insert includes an insert top, extending from at least one of the first insert side, second insert side, and divider, and selectively pivotable between at least a first position in which the insert top closes one of the two or more compartments and a second position in which the insert top opens the one of the two or more compartments, while the plurality of sides and the bottom continue to define the interior of the box.

16. The box of claim 13 wherein the divider is the same or approximately the same height as at least one of the sides the divider extends between.

17. The box of claim 13 wherein the divider is configured to form a gate and a gate axis, a portion of the divider being operable to pivot about the gate axis to temporarily widen the gate for receiving a content of the box, the divider having a divider end adapted to retain a shape of the divider when the box is formed, the gate being adjacent at least one box side, the at least one box side forming a boundary of the gate, and the divider dividing the interior of the box into at least two compartments that are closed when the box top is in the first position.

* * * * *